US005435827A

United States Patent [19]

Wisell

[11] Patent Number: 5,435,827

[45] Date of Patent: Jul. 25, 1995

[54] HIGH SPEED STEEL MANUFACTURED BY POWER METALLURGY

[75] Inventor: Henry Wisell, Söderfors, Sweden

[73] Assignee: Erasteel Kloster Aktiebolag, Soderfors, Sweden

[21] Appl. No.: 193,034

[22] PCT Filed: Jun. 30, 1992

[86] PCT No.: PCT/SE92/00487

§ 371 Date: Feb. 4, 1994

§ 102(e) Date: Feb. 4, 1994

[87] PCT Pub. No.: WO93/02818

PCT Pub. Date: Feb. 18, 1993

[30] Foreign Application Priority Data

Aug. 7, 1991 [SE] Sweden ..... 9102298
Dec. 19, 1991 [SE] Sweden ..... 9103766

[51] Int. Cl.[6] ..... C22C 38/00

[52] U.S. Cl. ..... 75/236; 75/239; 75/240; 75/243; 75/246; 420/105; 420/122; 420/124; 420/127

[58] Field of Search ..... 75/246, 243, 239, 240, 75/236; 420/105, 122, 124, 127

[56] References Cited

U.S. PATENT DOCUMENTS

| | | | |
|---|---|---|---|
| 3,809,541 | 5/1974 | Stevens | 75/236 |
| 4,116,684 | 9/1978 | Uchida et al. | 420/101 |
| 4,121,929 | 10/1978 | Kawai et al. | 75/238 |
| 4,224,060 | 9/1980 | de Souza et al. | 420/100 |
| 4,459,162 | 7/1984 | Norström et al. | 420/106 |
| 4,808,226 | 2/1989 | Adam | 75/246 |
| 4,913,737 | 4/1990 | Nakamura et al. | 75/228 |
| 4,936,911 | 6/1990 | Roberts et al. | 75/238 |
| 4,964,908 | 10/1990 | Greetham | 75/241 |

FOREIGN PATENT DOCUMENTS

| | | | |
|---|---|---|---|
| 0165409 | 12/1985 | European Pat. Off. | C22C 33/02 |
| 2352620 | 5/1979 | Germany | C22C 33/02 |
| 3285040 | 12/1991 | Japan . | |

*Primary Examiner*—Ngoclan Mai
*Attorney, Agent, or Firm*—Marks & Murase; Michael D. Bednarek

[57] ABSTRACT

A high speed steel which has been manufactured power metallurgically and has the following chemical composition in weight-%: 0.6–0.9 C, from traces to max 1.0 Si, from traces to max 1.0 Mn, 3–5 Cr, 0–5 Mo, 0–10 W, where (Mo+W/2) shall be at least 4, 0.7–2 V, max 14 Co, 0.7–1.5 Nb, with the balance being substantially iron, incidental impurities and accessory elements in normal amounts. The steel is suited for tools the use of which require a high toughness, a suitable hardness and strength.

16 Claims, 2 Drawing Sheets

Hardness vs hardening temperature after tempering
3 x 1 h at 560°C

HRC
66
64
62
60
58
56
54
52
50
950
1000
1050
1100
1150
1200
Hardening temp °C
9
8
7
3
6
4
5

Hardness vs tempering temperature from hardening temperature 1180°C,
tempering 3 x 1 h HRC
68
66
64
62
60
58
500
520
540
560
580
600
Tempering temp °C
9
8
7
3
6
4
5

Bend strength vs hardness

Rmb, kN/mm²
Hardness HRC
7
6
5
4
3
2
59
60
61
62
63
64
65
66
67
68
5
4
3
7
8
2
9

Toughness vs hardness

Deflection, mm
Hardness HRC
8
6
4
2
0
59
60
61
62
63
64
65
66
67
68
4
5
3
2
7
8,9

HIGH SPEED STEEL MANUFACTURED BY POWER METALLURGY

BACKGROUND OF THE INVENTION

The invention relates to a new high speed steel suited for tools the use of which requires a high toughness in combination with a hardness and strength suitable for the application in question. Typical applications are dies for the extrusion of aluminum profiles, qualified machine elements and pressure rolls, i.e. tools for embossing patterns or profiles in metals, etc. Another field of application is tools for cutting working, e.g. thread cutting taps and end-cutters with chip breakers, which require a high toughness in combination with a high hardness, particularly a high hot hardness.

One of the most important features of a steel which shall be used, e.g., for tools for the extrusion of aluminum profiles is that the steel is tempering resistant, which means that it shall be able to be exposed to a high temperature during a long period of time without losing the hardness which the steel has obtained after hardnening and tempering. On the other hand, this hardness need not be extremely high, suitably being in the range 50–55 HRC.

A high hardness and strength in combination with a high toughness are primary features if the steel instead shall be used for qualified machine elements. In this case, the hardness after tempering typically may be in the range 55-60 HRC.

Still higher demands upon hardness, 60–67 HRC, even in combination with a high toughness are raised on steels for tools intended for embossing patterns or profiles in metals, etc., and on steels for tools for cutting working, i.e. thread cutting taps and end cutters with chip breakers. Thread cutting taps should have a hardness in the range 60–65 HRC while end cutters should have a hardness in the range 62–67 HRC.

For applications of the above mentioned kind there are contemporarily usually used such tools steels as hot work steels, qualified constructionsteels and sometimes high speed steels. An example of a high speed steel for this type of application is the commercial high speed steel which is known under its trade name ASP® 23 (currently available from Erasteel Kloster Aktiebolag, a Swedish corporation), which is characterized by the following nominal composition in weight-%: 1.29 C, 0.4 Si, 0.3 Mn, 4.0 Cr, 5.0 Mo, 6.2 W, 3.1 V, balance iron and unavoidable impurities. Another high speed steel which is used, e.g., for cutting working, is ASP® 30 (currently available from Erasteel Kloster Aktiebolag, a Swedish corporation), which has the nominal composition 1.28 C, 4.2 Cr, 5.0 Mn, 6.4 W, 3.1 V, 8.5 Co, balance iron and unavoidable impurities. All percentages relate to weight-%.

The above-mentioned commercially available steels ASP®, 23 and ASP®, 30 have a considerable toughness in comparison with other high speed steels but do not completely satisfy those demands which are raised on materials, e.g., for the above mentioned applications, nor do any other commercial steels currently exist which fully satisfy all the said demands. The purpose of the invention is to provide a new high speed steel which more satisfactorily fulfills these demands. More particularly, the steel shall have the following features:

it shall have a high toughness in the hardened condition;

a hardness of max 250 HB before hardening;

a good hardenability, including precipitation hardenability to a hardness between 50 and 67 HRC suitable for the application in question, by choice of a hardening temperature between 925 and 1225° C. and subsequent tempering; and a high toughness in the hardened and tempered condition by the fact that the steel contains a comparatively small total amount of carbides, max 5% by volume, that the carbides are small and evenly distributed, that the microstructure is fine grained corresponding to austenite grains having sizes corresponding to Intercept>20 according to Snyder-Graff), and that it has a low content of retained austenite.

These and other conditions may be satisfied if the steel is given a balanced alloy composition according to the appending claims. In the following, the choice of the various alloy elements will be discussed. Herein, some theories will be mentioned concerning mechanisms which are considered to be the basis for the achieved effects. It shall, however, be noted that the claimed patent protection is not bound to any particularly theory.

DESCRIPTION OF THE INVENTION

Carbon has several functions in this steel. Above all, carbon shall exist to a certain amount in the matrix in order to afford the matrix a suitable hardness through the formation of martensite by cooling from the dissolution temperature and to an amount sufficient for the combination of carbon with in the first place molybdenum/tungsten and vanadium during tempering after the dissolution treatment for the achievement of precipitation hardening by the formation of $M_2C$- and MC-carbides, respectively. Carbide also exists in the steel in the form of niobium carbide which is not dissolved at the hardening process but can work as grain growth inhibitors in the grain boundaries of the microstructure of the steel. Therefore, the carbon content in the steel shall be at least 0.6% and preferably at least 0.65%, :suitably at least 0.67%. On the other hand the carbon content must not be so high that it will cause brittleness. The maximal carbon content in the steel therefore generally is 0.85%, at least for those applications which do not require significant amounts of cobalt in order to afford the steel a high hot strength, preferably max 0.8%, suitably max 0.78% C. If the steel contains a high content of cobalt in order to provide a desired high hot hardness, e.g. if the steel shall be used for tools for cutting working, the carbon content may lie on a somewhat higher level, suitably max 0.9%, as the cobalt may have an influence upon the content of retained austenite, so that this readily may be converted to martensite when tempering. The nominal carbon content is 0.75% when the steel shall be used for products at the use of which a hardness in the range 58–65 HRC, preferably at least 60 HRC, is desired, e.g. for embossing tools. If the steel instead shall be used e.g. for tools for the extrusion of aluminum profiles, a hardness higher than 50–58 HRC, preferably max 55 HRC, is not required. In this case a nominal carbon content of 0.70% may be more suitable. One may also conceive a nominal carbon content of 0.73% for products which shall have a hardness between or overlapping these extremes, or 55–60 HRC, e.g., for qualified machine elements. If the steel shall be used for tools for cutting work, which tools require a high hot hardness so that the steel ought to contain cobalt in higher amounts and a hardness in the range 62–67 HRC, the nominal carbon content suitably is 0.80%.

Silicon may exist in the steel as a residue from the deoxidation of the steel melt in amounts which are normal from the metallurgical deoxidation praxis, i.e., max 1.0%, normally max 0.7%.

Manganese may also exist in the first place as a residue from the melt-metallurgical process-technique, where manganese has importance in order to make sulphur impurities harmless, in a manner known per se, through the formation of manganese sulphides. The maximal content of manganese in the steel is 1.0%, preferably max 0.5%.

Chromium shall exist in the steel in an amount of at least 3%, preferably at least 3.5%, in order to contribute to a sufficient hardness of the matrix of the steel. Too much chromium, however, will cause a risk for retained austenite which may be difficult to transform. The chromium content therefore is limited to max 5%, preferably to max 4.5%.

Molybdenum and tungsten shall exist in the steel in order to bring about a secondary hardening effect during tempering after solution heat treatment because of the formation of $M_2C$ carbides, which contribute to the desired wear resistance of the steel. The ranges are adapted to the other alloying elements in order to bring about a proper secondary hardening effect. The content of molybdenum may be max 5% and the content of tungsten max 10%, preferably max 6%, and in combination Mo+W/2 shall be at least 4%. Normally each of molybdenum and tungsten should exist in an amount of 2–4%, suitably 2.5–3.5%. In principal, molybdenum and tungsten wholly or partly may replace each other, which means that tungsten may be replaced by half the amount of molybdenum and molybdenum be replaced by double the amount of tungsten. One knows, however, from experience that approximately the same proportions of molybdenum and tungsten are preferable on the present total level of these alloying elements, since this gives some production technical advantages, more particularly advantages relating to the heat treatment technique.

The total amount of $M_2C$-carbides which can be produced in the steel structure at the precipitation hardening treatment is limited. In order further to increase the hardness and wear strength of the steel after tempering, the steel alloy therefore also shall contain vanadium which combines with carbon at the tempering operation to form MC-carbides, wherein the secondary hardening is augmented through precipitation hardening. In order to obtain a sufficient effect, the content of vanadium should be at least 0.7%, suitably at least 0.8%. The content of vanadium, however, must not be too high in order that none-dissolved primary vanadium carbides may not be retained after the solution heat treatment, which retained primary carbides could impare the toughness and at the same time bind carbon intended for the precipitation hardening. Therefore the vanadium content is limited to max 2%, preferably to max 1.5%, suitably to max 1.3%.

The matrix of high speed steels known in the art having a composition comparable with that of the present invention will be brittle because of grain growth at the hardening from a high temperature, since the major part of the carbides are dissolved at the solution heat treatment. Conventionally a high toughness therefore is achieved by hardening from a lower temperature so that there will be a sufficient amount of carbides in the steel to inhibit the grain growth. This, however, at the same time implies that one has had to accept a lower hardness. This problem according to the invention is solved by two processes:

firstly, the steel is alloyed with niobium and with a sufficient amount of carbon—as far as carbon is concerned, se supra—in order to provide a sufficient amount of niobium carbides, NbC, which are not dissolved to a substantial degree at the above mentioned, high temperature but will remain undissolved to work as grain growth inhibitors.

secondly, measurements are taken in order that the primary niobium carbides be small and evenly distributed in the steel, which is a condition for their ability to work as grain growth inhibitors. This condition is satisfied by the powder-metallurgical manufacturing, which garantees that the niobium carbides be small and evenly distributed.

An amount of niobium in the steel suitable for the functioning of niobium as grain growth inhibitors under the above mentioned conditions is 0.7–1.5%, suitably 0.8–1.3%. Lower amounts of niobium do not provide a sufficient grain growth inhibiting effect, while higher amounts may cause embrittlement.

The possible presence of cobalt in the steel is determined by the intended use of the steel. For applications where the steel normally is used at room-temperature or where the steel is not heated to particularly high temperatures during use, the steel should not contain intentionally added cobalt, since cobalt reduces the toughness of the steel. However, cobalt can be tolerated in amounts up to max 1.0%, preferably max 0.5%. If the steel shall be used for tools for cutting work, wherein the hot hardness is of primary importance, it is on the ,other hand suitable that the steel contains significant amounts of cobalt, which in that case should exist in an amount between 2.5 and 14%, suitably max 10% cobalt, in order to provide a desired hot hardness.

Besides the above mentioned elements, the steel contains nitrogen, unavoidable impurities and other residual products in normal amounts derived from the melt-metallurgical treatment of the steel. Other elements can intentionally be supplied to the steel in minor amounts, provided they do not detrimentally change the intended ineractions between the alloying elements of the steel and also that they do not impair the intended features of the steel and its suitability for the intended applications.

BRIEF DESCRIPTION OF THE DRAWINGS

The invention will be further explained in the following description with reference to performed experiments and to achieved results. Herein reference will be made to the accompanying drawings, in which.

The composition of the examined steels are given in Table 1. Besides the alloying elements given in the table, the steels only contained iron and impurities and accessory elements in normal amounts. All the steels No. 1–7, except steel No. 2, were manufactured powder-metallurgically in the form of 200kg capsules, which were consolidated to full density through hot isostatic pressing at 1150° C., 1 h and 1000 bar. Steel No. 2 was manufactured conventionally in the form of an ingot. From the capsules and from the ingot, respectively, there were made rods with the dimension 100 mm $\phi$ through conventional hot rolling. Steel Nos. 8 and 9 are reference materials corresponding to the commercially steel grades ASP® 23 and ASP®, 30, respectively.

TABLE 1

| Steel No. | C | Si | Mn | Cr | Mo | W | V | Nb | Co |
|---|---|---|---|---|---|---|---|---|---|
| 1 | 0.51 | 0.43 | 0.28 | 4.2 | 3.0 | 3.1 | 1.41 | — | 0.03 |
| 2 | 0.60 | 0.49 | 0.31 | 3.9 | 3.0 | 2.9 | 1.20 | — | 0.02 |
| 3 | 0.81 | 0.53 | 0.30 | 4.14 | 3.03 | 3.07 | 1.00 | 1.09 | — |
| 4 | 0.75 | 0.48 | 0.31 | 3.99 | 2.99 | 3.07 | 1.01 | 1.10 | — |
| 5 | 0.70 | 0.69 | 0.30 | 3.97 | 3.05 | 3.06 | 0.99 | 1.16 | |
| 6 | 0.83 | 0.37 | 0.34 | 4.1 | 2.9 | 3.0 | 1.1 | 1.1 | 0.32 |
| 7 | 0.80 | 0.48 | 0.27 | 4.0 | 3.0 | 3.0 | 1.0 | 1.1 | 7.9 |
| 8 | 1.29 | 0.40 | 0.30 | 4.0 | 5.0 | 6.2 | 3.1 | — | — |
| 9 | 1.28 | 0.50 | 0.30 | 4.0 | 5.0 | 6.4 | 3.1 | — | 8.5 |

Figure 1:
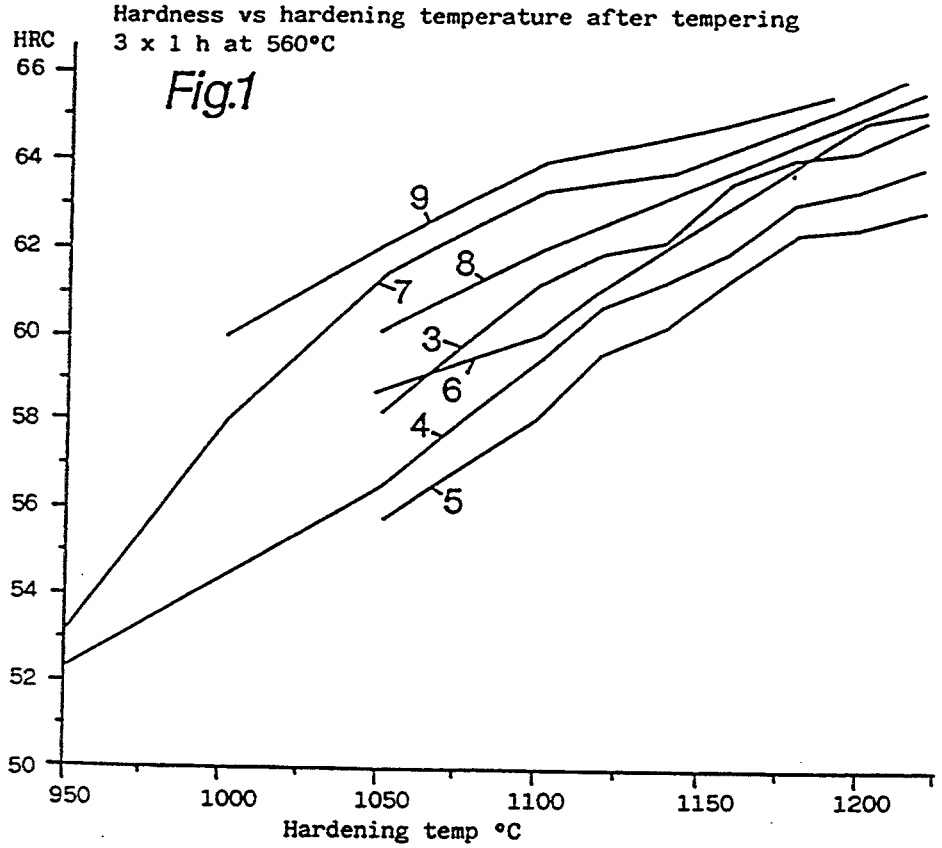
FIG. 1 shows the hardness after tempering versus the hardening temperature.

Steel Nos. 3–9 were hardened through solution heat treatment at temperatures varying between 1050 and 1250° C. (steel No. 4 between 950 and 1250° C.), cooling to room-temperature and tempering at 560° C. The solution heat treatment was made during 3 min, while the tempering, which was repeated three times, was made during a holding time of 60 min. The achieved hardnesses versus the hardening temperature (the temperature for the solution heat treatment) are shown in FIG. 1.

In the second series of experiments with the same steels, the tempering temperatures varied between 500° and 600° C. In this case test specimens were used which had been hardened from 1180° C. The hardness versus the tempering temperature is shown in FIG. 2.

In the third series of experiments the bending strength versus the hardness of the steels 2–5 and 7–9 were examined. The results are shown by the curves in FIG. 3.

Finally the toughness of the same steels versus the hardness in a four-point bending test was examined. Cylindrical test rods were bent to rupture. The deflection at rupture was measured, which is a measurement of the toughness. The results are shown by the diagrams in FIG. 4.

Figure 2:
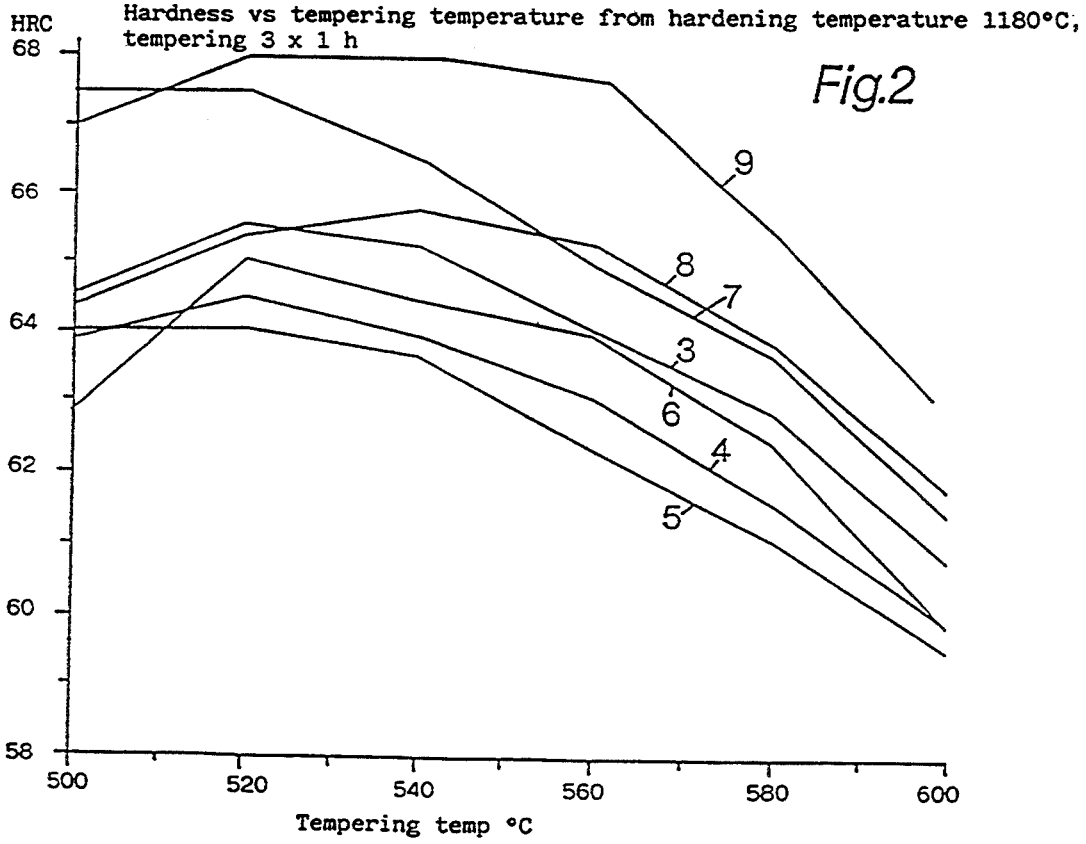
FIG. 2 shows the hardness versus the temperature.
Figure 3:
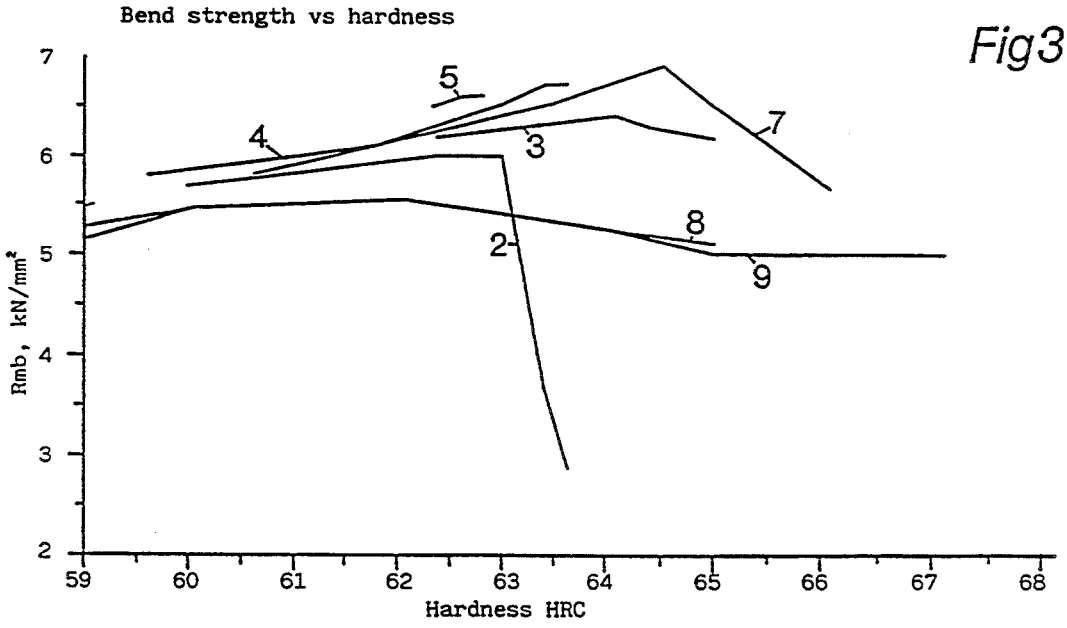
FIG. 3 shows the bending strength versus the hardness.
Figure 4:
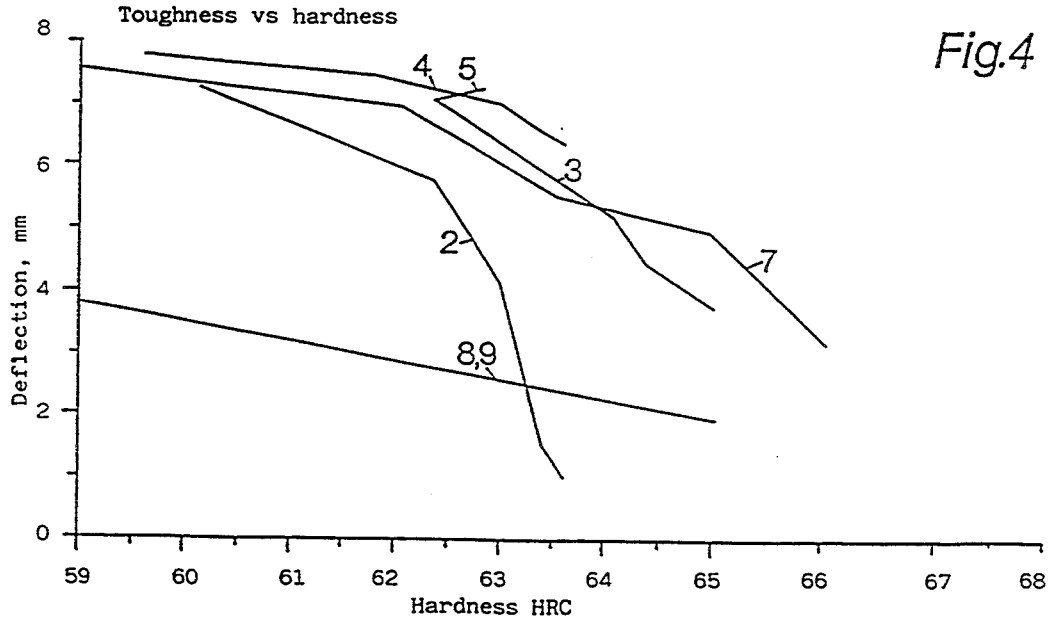
FIG. 4 shows the toughness expressed as deflection prior to rupture versus the hardness.

FIG. 1 ;and FIG. 2 show that it is possible to obtain a suitable hardness of the steels of the invention for the conceived applications after tempering if a suitable hardening temperature between 925 and 1250° C. is chosen. FIG. 3 and FIG. 4 show that the best strength and the best toughness are achieved with the niobium containing steels of the invention, particularly with steels No. 4, No. 5 and No. 7.

I claim:

1. High-speed steel manufactured powder-metallurgically and comprising the following chemical composition in weight-%:

| | |
|---|---|
| 0.6–0.9 | C |
| from traces to max 1.0 | Si |
| from traces to max 1.0 | Mn |
| 3–5 | Cr |
| 0–5 | Mo |
| 0–10 | W, where (Mo + W/2) shall be at least 4 |
| 0.7–2 | V |
| max 14 | Co |
| 0.7–1.5 | Nb |

with the balance being substantially iron incidental impurities and accessory elements.

2. High-speed steel according to claim 1, comprising the following chemical composition in weight-%:

| | |
|---|---|
| 0.6–0.85 | C |
| from traces to max 1.0 | Si |
| from traces to max 1.0 | Mn |
| 3–5 | Cr |
| 2–4 | Mo |
| 2–4 | W |
| 0.7–1.5 | V |
| max 1.0 | Co |
| 0.7–1.5 | Nb |

with the balance being substantially iron, incidental impurities and accessory elements.

3. Steel according to claim 1, comprising the following chemical composition in weight-%: 0.6–0.8% C, max 1.0% Si, max 1.0% Mn, 3.5–4.5% Cr, 2.5–3.5% Mo, 2.5–3.5% W, 0.8–1.3% V, max 1.0% Co, 0.8–1.3% Nb.

4. Steel according to claim 3, comprising the following chemical composition in weight-%: 0.65–0.8% C, max 1.0% Si, max 1.0% Mn, 3.7–4.3% Cr, 2.7–3.3% Mo, 2.7–3.3% W, 0.8–1.3% V, 0.8–1.3% Nb.

5. Steel according to any one of claims 2–4, comprising in weight-% 0.67–0.78% C.

6. Steel according to any one of claims 1–4, comprising in weight-% max 0.5% Si and max 0.5% Mn.

7. Steel according to claim 1, comprising the following chemical composition in weight-%:

| | |
|---|---|
| 0.6–0.9 | C |
| from traces to max 1.0 | Si |
| from traces to max 1.0 | Mn |
| 3–5 | Cr |
| 0–5 | Mo |
| 0–10 | W |
| 0.7–2 | V |
| 2.5–14 | Co |
| 0.7–1.5 | Nb |

with the balance being substantially iron, incidental impurities and accessory elements.

8. Steel according to claim 7, comprising the following chemical composition in weight-%:

| | |
|---|---|
| 0.75–0.85 | C |
| 3–5 | Cr |
| 2–4 | Mo |
| 2–6 | W |
| 0.7–1.5 | V |
| 2.5–10 | Co |
| 0.7–1.5 | Nb |

with the balance being substantially iron, incidental impurities and accessory elements.

9. Steel according to claim 1, wherein tungsten is wholly or partly replaced by half the amount of molybdenum, or molybdenum is wholly or party replaced by double the amount of tungsten.

10. Steel according to claim 1, comprising the following chemical composition in weight-%: 0.75% C, 0.2–0.5% Si, 0.2–0.5% Mn, 4% Cr, 3% Mo, 3% W, 1% V, 1% Nb, with the balance being substantially iron, incidental impurities and accessory elements.

11. Steel according to claim 1, comprising the following chemical composition in weight-%: 0.73% C, 0.2–0.5% Si, 0.2–0.5% Mn, 4% Cr, 3% Mo, 3% W, 1% V, 1% Nb, with the balance being substantially iron, incidental impurities and accessory elements.

12. Steel according to claim 1, comprising the following chemical composition in weight-%: 0.70% C, 0.2–0.5% Si, 0.2–0.5% Mn, 4% Cr, 3% Mo, 3% W, 1% V, 1% Nb, with the balance being substantially iron, incidental impurities and accessory elements.

13. Steel according to claim 7, comprising the following chemical composition in weight-%: 0.80% C, 0 2–0 5% Si, 0.2–0.5% Mn, 4% Cr, 3% MO 3% W, 1% v, 1% Nb, 8% Co, with the balance being substantially iron, incidental impurities and accessory elements.

14. An object manufactured of a steel according to claim 1, wherein said steel of the object has a microstructure containing 1–3 volume-% of secondarily precipitated $M_2C$- and MC-carbides in a fine grain, substantially martensitic matrix which, besides the said $M_2C$- and MC-carbides and niobium carbides, is substantially free from carbides.

15. The manufactured object according to claim 14, wherein said matrix has a microstructure in which the austenite grains have a size corresponding to an Intercept>20 according to Snyder-Graff.

16. The manufactured object according to claim 14, wherein the steel of said object has been hardened through solution heat treatment at a temperature between 925° and 1250° C., cooled to room temperature, and tempered at between 500° and 600° C.

* * * * *